US008870353B2

(12) United States Patent
Watanabe

(10) Patent No.: US 8,870,353 B2
(45) Date of Patent: Oct. 28, 2014

(54) LIQUID EJECTING HEAD, LIQUID EJECTING HEAD UNIT AND LIQUID EJECTING APPARATUS

(75) Inventor: Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 394 days.

(21) Appl. No.: 13/075,146

(22) Filed: Mar. 29, 2011

(65) Prior Publication Data

US 2011/0242185 A1 Oct. 6, 2011

(30) Foreign Application Priority Data

Mar. 30, 2010 (JP) ..... 2010-077515

(51) Int. Cl.

| | |
|---|---|
| ***B41J 2/045*** | (2006.01) |
| *B41J 2/015* | (2006.01) |
| *B41J 2/15* | (2006.01) |
| *B41J 2/145* | (2006.01) |
| *B41J 2/04* | (2006.01) |
| *B41J 2/05* | (2006.01) |
| *B41J 2/17* | (2006.01) |
| *B41J 2/175* | (2006.01) |
| *B41J 2/14* | (2006.01) |

(52) U.S. Cl.

CPC .... *B41J 2/14274* (2013.01); *B41J 2002/14419* (2013.01)

USPC ..... 347/70; 347/20; 347/40; 347/54; 347/60; 347/65; 347/68; 347/71; 347/72; 347/84; 347/85; 347/86; 347/87; 347/88

(58) Field of Classification Search

CPC .. B41J 2/04563; B41J 2/0458; B41J 2/04528; B41J 2/04531; B41J 2002/14177

USPC ..... 347/20, 40, 54, 60, 65, 68, 70–72, 347/84–88, 17

See application file for complete search history.

(56) References Cited

U.S. PATENT DOCUMENTS

| | | | | |
|---|---|---|---|---|
| 4,418,355 | A * | 11/1983 | DeYoung et al. | 347/70 |
| 4,719,472 | A * | 1/1988 | Arakawa | 347/67 |
| 5,191,360 | A * | 3/1993 | Pohlig | 347/17 |
| 5,424,767 | A * | 6/1995 | Alavizadeh et al. | 347/17 |
| 6,234,599 | B1 * | 5/2001 | Ishinaga et al. | 347/14 |
| 6,450,615 | B2 * | 9/2002 | Kojima et al. | 347/46 |
| 7,207,641 | B2 * | 4/2007 | Komatsu et al. | 347/17 |
| 7,874,652 | B2 * | 1/2011 | Sugahara | 347/70 |
| 7,988,068 | B2 * | 8/2011 | Mita | 239/102.2 |
| 8,277,030 | B2 * | 10/2012 | Nagate | 347/68 |
| 2007/0263038 | A1 * | 11/2007 | Bibl | 347/56 |

FOREIGN PATENT DOCUMENTS

| | | | | |
|---|---|---|---|---|
| JP | 2003062997 | A * | 3/2003 | B41J 2/045 |
| JP | 2008-055716 | A | 3/2008 | |

* cited by examiner

*Primary Examiner* — Laura Martin
*Assistant Examiner* — Jeremy Bishop
(74) *Attorney, Agent, or Firm* — Kilpatrick Townsend & Stockton LLP

(57) ABSTRACT

A liquid ejecting head includes a pressure generation chamber which fluidly communicates with a nozzle opening through which liquid is discharged, a pressure generation unit which causes pressure change on liquid in the pressure generation chamber, a manifold which serves as a liquid chamber common to a plurality of the pressure generation chambers, a flexible film which is configured to cover the manifold so as to absorb a pressure change generated in the manifold, and a heat generation unit which is formed on the flexible film at a region opposed to the manifold and is made of a pattered metal.

12 Claims, 6 Drawing Sheets

LIQUID EJECTING HEAD, LIQUID EJECTING HEAD UNIT AND LIQUID EJECTING APPARATUS

CROSS REFERENCES TO RELATED APPLICATIONS

The entire disclosure of Japanese Patent Application No. 2010-77515, filed Mar. 30, 2010 is expressly incorporated herein by reference.

BACKGROUND

1. Technical Field

The present invention relates to a liquid ejecting head, a liquid ejecting head unit and a liquid ejecting apparatus which eject liquid through nozzle openings, in particular, relates to an ink jet recording head, an ink jet recording head unit and an ink jet recording apparatus which discharge ink as liquid.

2. Related Art

For example, as disclosed in JP-A-2008-55716, there is an ink jet recording head in which viscosity of ink is lowered by heating the ink in an ink supply path in order to discharge high viscous ink represented by UV ink. In the ink jet recording head disclosed in JP-A-2008-55716, a liquid flow path through which heated water for heating ink is flown is provided in the head so that ink having lowered viscosity is stably flown through an ink supply path. Therefore, an excellent ink discharging characteristic can be obtained.

In the ink jet recording head disclosed in JP-A-2008-55716, ink is heated by heated water which has been heated by a heater provided outside the head. Therefore, the temperature of the ink is easily changed due to the influence by external environment before the ink reaches to pressure generation chambers in the head. Accordingly, the temperature of ink in the head cannot be made to be a desired temperature in some case even when the temperature of the heated water is controlled with a sensor provided outside the head. In such a case, there arises a problem that ink cannot be made to have desired viscosity so that an excellent discharging characteristic cannot be obtained.

It is to be noted that such problem arises not only in an ink jet recording head which discharges ink having high viscosity but also in an ink jet recording head which discharges ink after viscosity of the ink is lowered by heating the ink. Further, the above problem also arises not only in an ink jet recording head which discharges ink but also in a liquid ejecting head which discharges liquid other than ink.

SUMMARY

A liquid ejecting head according to an aspect of the invention includes a pressure generation chamber which fluidly communicates with a nozzle opening through which liquid is discharged, a pressure generation unit which causes pressure change on liquid in the pressure generation chamber, a manifold which serves as a liquid chamber common to a plurality of the pressure generation chambers, a flexible film which is configured to cover at least a portion of the manifold so as to absorb a pressure change generated in the manifold, and a heat generation unit which is formed on the flexible film at a region opposed to the manifold and is made of a patterned metal.

A liquid ejecting apparatus according to another aspect of the invention includes the above liquid ejecting head or a liquid ejecting head unit using the above liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention is described in detail based on embodiments.

First Embodiment

Figure 1:
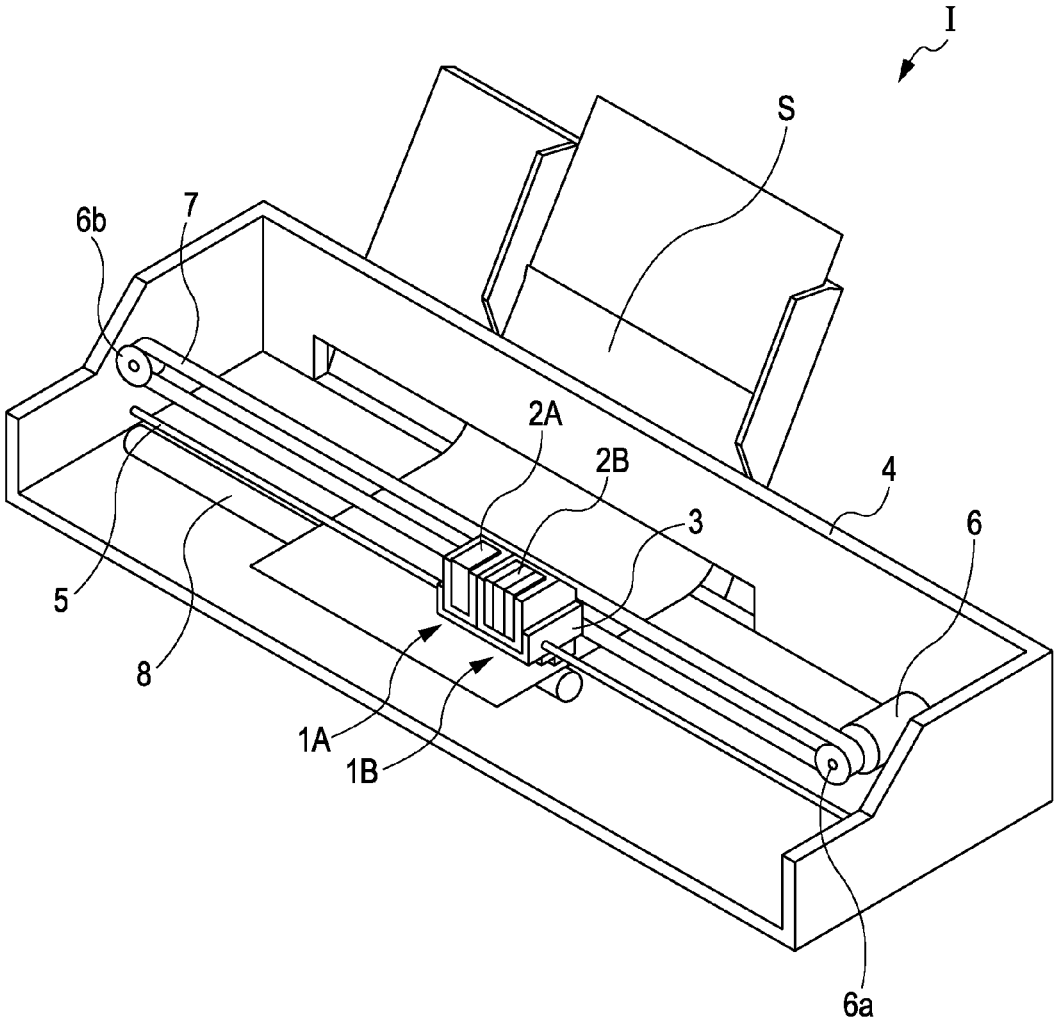
FIG. 1 is a schematic view illustrating a recording apparatus according an embodiment of the invention.

FIG. 1 is a perspective view illustrating a schematic configuration of an ink jet recording apparatus as an example of a liquid ejecting apparatus according to a first embodiment of the invention.

As shown in FIG. 1, an ink jet recording apparatus I as an example of a liquid ejecting apparatus includes an ink jet recording head 100 which will be described later. To be more specific, as shown in FIG. 1, cartridges 2A and 2B constituting an ink supply unit are detachably provided on recording head units 1A and 1B each having the ink jet recording head 100. A carriage 3 on which the recording head units 1A and 1B are mounted is provided on a carriage shaft 5 attached to an apparatus main body 4 so as to be movable in the shaft direction. For example, the recording head units 1A and 1B discharge black ink composition and color ink composition, respectively.

A driving force of a driving motor 6 is transmitted to the carriage 3 through a plurality of gears (not shown) and a timing belt 7 so that the carriage 3 on which the recording head units 1A and 1B are mounted is moved along the carriage shaft 5. Further, a platen 8 is provided on the apparatus main body 4 along the carriage shaft 5. A recording sheet S as a recording medium such as a sheet fed by a sheet feeding roller (not shown) and the like is transported while being wound over the platen 8.

Figure 2A:
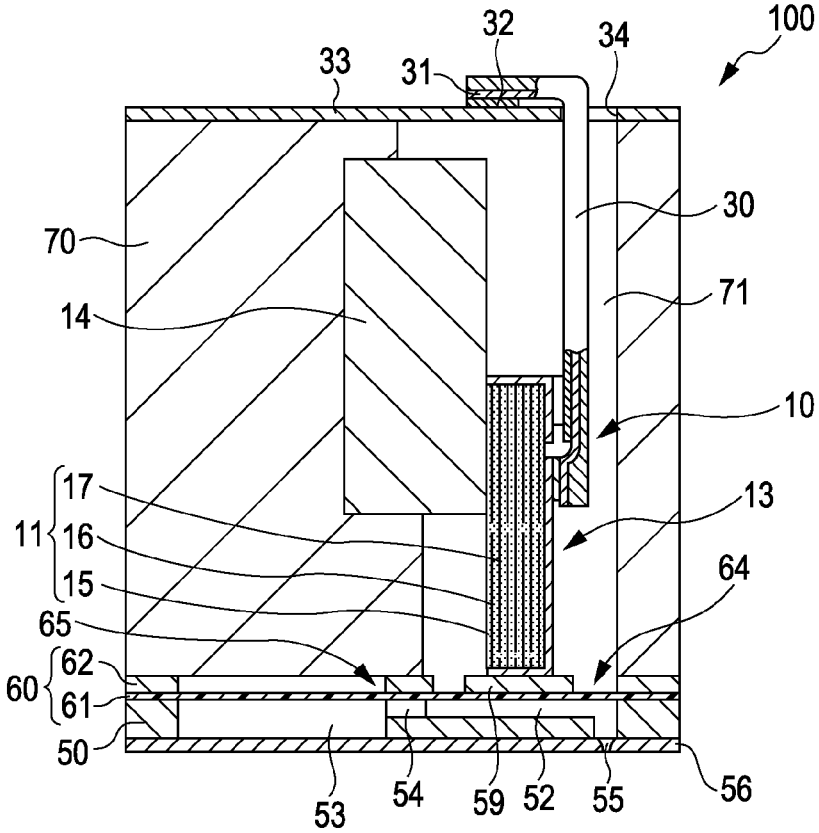
FIGS. 2A and 2B are cross-sectional views illustrating a recording head according to a first embodiment of the invention.
Figure 2B:
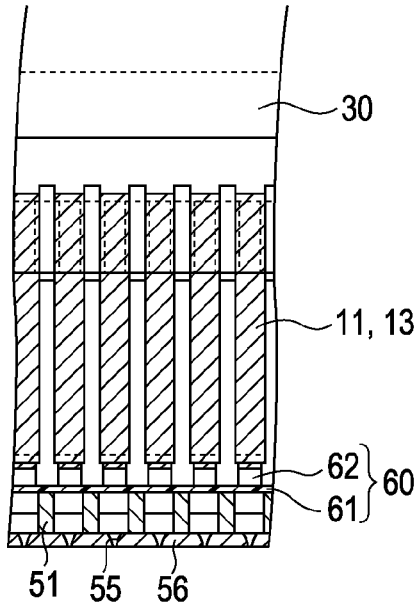

The ink jet recording head 100 mounted on the ink jet recording apparatus I having the above configuration will be described. FIG. 2A is a cross-sectional view illustrating a pressure generation chamber in an ink jet recording head as an example of a liquid ejecting head according to the first embodiment of the invention in a lengthwise direction. FIG. 2B is a cross-sectional view illustrating a main part of the pressure generation chamber in the ink jet recording head in a short-side direction.

As shown in FIGS. 2A and 2B, a flow path formation substrate 50 is formed with a silicon single crystal substrate and pressure generation chambers 52 which are defined by a plurality of separation walls 51 are arranged on a surface layer portion at one surface side of the flow path formation substrate 50 so as to be in parallel with each other in a width direction (short-side direction). Further, a manifold 53 is fluidly communicated with one-side ends of the pressure generation chambers 52 in the lengthwise direction through ink supply paths 54 as an example of a liquid supply opening. The manifold 53 is a portion for supplying ink as an example of liquid to each of the pressure generation chambers 52. That is to say, the manifold 53 is a liquid chamber which is common to each of the pressure generation chambers 52. In addition, opening surface sides of the pressure generation chambers 52 on the flow path formation substrate 50 are sealed with a vibration plate 60. A nozzle plate 56 as an example of a nozzle formation member is adhered to the other surface sides of the pressure generation chambers 52 through an adhesive or a thermal welding film. Nozzle openings 55 are bored on the nozzle plate 56. In the embodiment, a liquid flow path constituted by the pressure generation chambers 52, the ink supply paths 54 and the manifold 53 is provided on the flow path formation substrate 50.

The vibration plate 60 formed on the flow path formation substrate 50 is formed by a composite plate of an elastic film 61 and a supporting plate 62. The elastic film 61 is made of a flexible material such as a resin film, for example. The supporting plate 62 supports the elastic film 61 and is made of a metal material or the like, for example. The vibration plate 60 is bonded to the flow path formation substrate 50 at the side of the elastic film 61. For example, in the embodiment, the elastic film 61 is formed by a polyphenylene-sulfide (PPS) film having a thickness of substantially several μm and the supporting plate 62 is formed by a stainless steel (SUS) having a thickness of substantially several tens μm.

Further, island portions 59 against which tips of piezoelectric elements 11 abut are provided on the vibration plate 60 at regions opposed to the pressure generation chambers 52. That is to say, thin walled portions 64 which are thinner than other regions are formed on the vibration plate 60 at regions opposed to circumferential portions of the pressure generation chambers 52 and each island portion 59 is provided at an inner side of each thin-walled portion 64.

Further, in the embodiment, a compliance portion 65 is provided on the vibration plate 60 at a region opposed to the manifold 53. The compliance portion 65 is formed by substantially only the elastic film 61 by removing the supporting plate 62 by etching as in the thin-walled portions 64. That is to say, the supporting plate 62 of the vibration plate 60 has an opening penetrating through the supporting plate 62 in the thickness direction at a region opposed to the manifold 53. The region of the elastic film 61 which is opposed to the manifold 53 corresponds to the compliance portion 65. It is to be noted that the compliance portion 65 (flexible film) is configured so as to be bent. Therefore, when pressure in the manifold 53 is changed, the elastic film 61 on the compliance portion 65 is deformed so as to absorb the pressure change generated in the manifold 53. Accordingly, the compliance portion 65 plays a role in keeping the pressure in the manifold 53 to be constant all the time.

As described above, in the embodiment, the opening surface sides of the pressure generation chambers 52 on the flow path formation substrate 50 are sealed with the vibration plate 60. Namely, the manifold 53 is sealed with the vibration plate 60. Further, a heat generation unit is provided on the elastic film 61 at a region opposed to the manifold 53, that is, on the compliance portion 65. The heat generation unit is made of a metal pattern.

Figure 3:
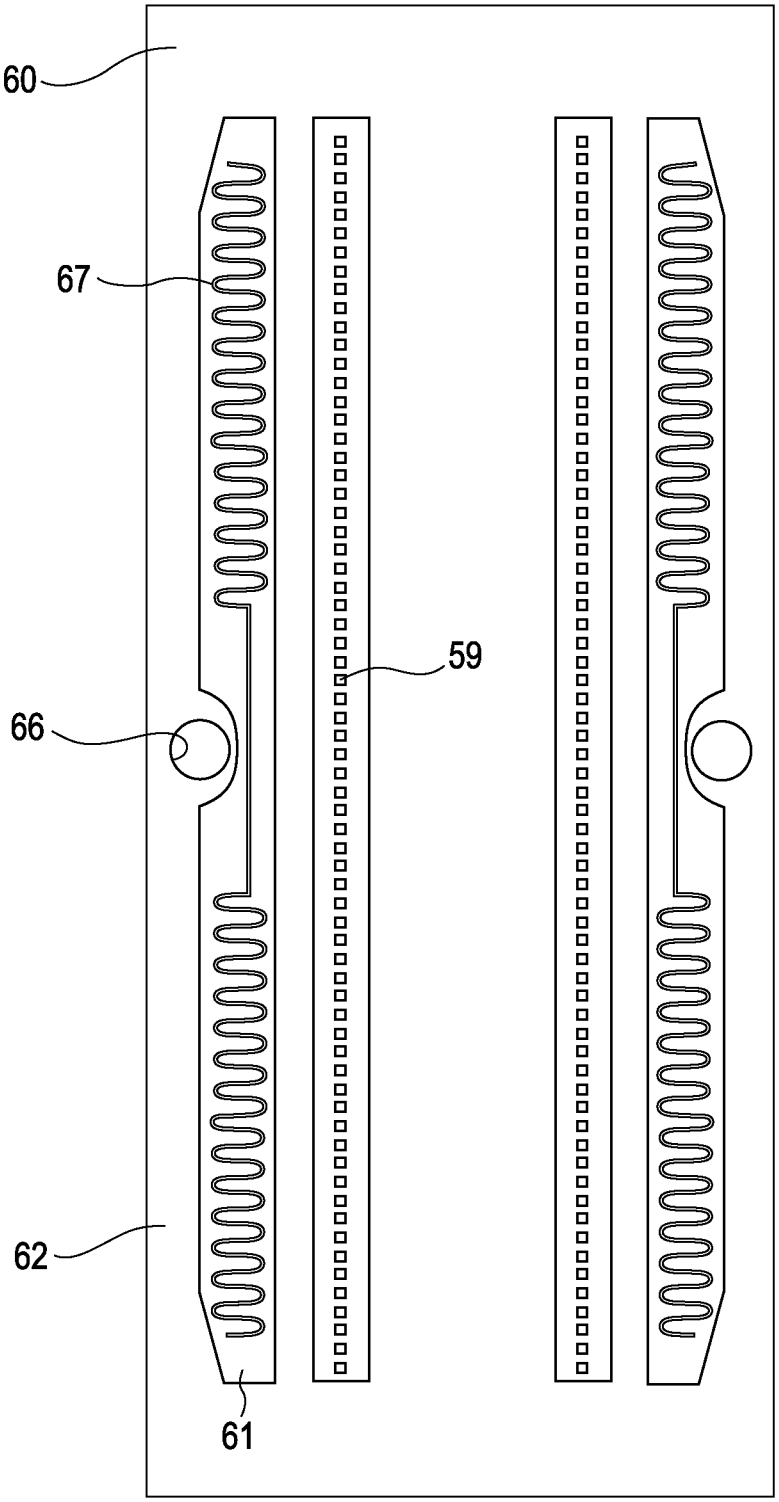
FIG. 3 is a plan view illustrating a sealing substrate according to the first embodiment of the invention.

Next, the heat generation unit is described in detail. FIG. 3 is a plan view illustrating a sealing substrate (vibration plate 60) according to the first embodiment of the invention.

As shown in FIG. 3, the vibration plate 60 is formed by the elastic film 61 and the supporting plate 62. Further, an ink supply hole 66 is provided on the vibration plate 60 so as to penetrate through the vibration plate 60 in the thickness direction. The ink supply hole 66 supplies liquid to the manifold 53.

Further, the supporting plate 62 has an opening which penetrates therethrough in the thickness direction at a region corresponding to the manifold 53 as described above. Therefore, the elastic film 61 is exposed at the region. The exposed portion of the elastic film 61 corresponds to the compliance portion 65. Further, a heat generation unit 67 which is made of a patterned metal is provided on the compliance portion 65 of the elastic film 61. That is to say, the heat generation unit 67 which is made of a patterned metal is provided on the elastic film 61 at a region opposed to the manifold 53. The heat generation unit 67 is connected to a power supply (not shown) so that a voltage can be applied to the heat generation unit 67.

Although the shape of the heat generation unit 67 is not particularly limited, the heat generation unit 67 according to the embodiment has a linear shape and is provided so as to wind on the elastic film 61. The heat generation amount of the heat generation unit 67 can be adjusted by adjusting the shape of the heat generation unit 67. For example, if the width of the heat generation unit 67 is made smaller or the length thereof is made longer, a resistance is increased so that the heat generation amount can be made larger. It is to be noted that the length referred in the specification indicates the length of the heat generation unit 67 provided at the region opposed to the manifold 53. The length of the heat generation unit 67 can be adjusted by controlling a pitch (interval) of the winding heat generation unit 67.

The material of the heat generation unit 67 is not particularly limited and various metals can be used for the heat generation unit 67. In the embodiment, the heat generation unit 67 is made of a metal material constituting the supporting plate (fixing member) 62. In other words, in the embodiment, the heat generation unit 67 which is made of the same material as that of the supporting plate 62 but is not continuous to the supporting plate 62 is provided. The heat generation unit 67 according to the embodiment can be formed at the same time when the opening is formed on the supporting plate 62.

Then, the method of forming the heat generation unit 67 is described simply. At first, the vibration plate 60 is formed by forming the elastic film 61 on one surface of the supporting plate 62. Then, a predetermined photoresist pattern is formed on the surface of the supporting plate 62, which is opposite to the elastic film 61, by a photolithography method, for example. The elastic film 61 is exposed by patterning the supporting plate 62 using the photoresist pattern. To be more specific, the elastic film 61 is exposed by removing the supporting plate 62 at a region opposed to the manifold 53 and a region on the vibration plate 60, which is opposed to the circumferential portions of the pressure generation chambers 52. At this time, as shown in FIG. 3, the heat generation unit 67 is formed on the region opposed to the manifold 53 such that the metal pattern which is not continuous to the supporting plate 62 is left. The heat generation unit 67 even having a complicated shape can be formed with high accuracy by using the photolithography method.

Further, if the heat generation unit 67 is formed on only the region opposed to the manifold 53, the compliance portion 65 is kept in an excessively bent state toward the side of the manifold 53 or the opposite side to the manifold 53. Therefore, there is a possibility that the compliance portion 65 is not sufficiently deformed and cannot sufficiently absorb pressure when pressure is generated in the manifold 53. However, in the embodiment, the heat generation unit 67 is formed so as to be continuously extendedly formed from the region opposed to the manifold 53 to the outside of the region. Therefore, the heat generation unit 67 located at the outside of the region serves as a supporting member which supports the heat generation unit 67 located at the region. To be more specific, the heat generation unit 67 at the outside region is formed thicker from the circumferential portion of the manifold 53 to the outside of the region in comparison with the heat generation unit 67 at the center of the region.

If a voltage is applied to the above heat generation unit 67, the heat generation unit 67 generates heat. With the heat, ink in the manifold 53 is heated. This makes it possible to lower viscosity of ink even when ink having high viscosity is used. Accordingly, ink can be supplied to the nozzle openings 55 with improved flowing state. Therefore, a difference in the discharge amount among the nozzles is suppressed so that a uniform amount of ink droplets is discharged through each nozzle opening 55 at a uniform rate.

A head case 70 is fixed onto the vibration plate 60. The head case 70 has an ink supply path as an example of a liquid supply path, which is connected to ink cartridges (not shown) as an example of a plurality of liquid storing units. Further, a piezoelectric element unit 10 is fixed to the head case 70 such that a positional range thereof is defined with high accuracy. That is to say, an accommodation portion 71 which penetrates through the head case 70 is provided inside the head case 70. Further, the piezoelectric element unit 10 is fixed to an inner surface of the accommodation portion 71 in a state where the tip of each piezoelectric element 11 abuts against each island portion 59 provided on the vibration plate 60 at a region corresponding to each pressure generation chamber 52.

In the embodiment, the piezoelectric elements 11 are integrally formed on a single piezoelectric element unit 10. That is to say, a piezoelectric element formation member 13 in which piezoelectric material layers 15 and electrode formation materials 16, 17 are alternately laminated in a sandwiching manner in a longitudinal direction is formed. Then, the piezoelectric element formation member 13 is cut in a comb-tooth pattern so as to correspond to each pressure generation chamber 52, thereby forming each piezoelectric element 11. That is to say, in the embodiment, the plurality of piezoelectric elements 11 are integrally formed. Then, inactive regions of the piezoelectric elements 11 (piezoelectric element formation member 13), which do not contribute to vibration, that is, base end sides of the piezoelectric elements 11 are firmly adhered to a fixing substrate 14. Although not shown in the drawing, a circuit substrate 30 is connected to surfaces of the piezoelectric elements 11, which are opposite to the fixing substrate 14, in the vicinity of the base ends of the piezoelectric elements 11. The circuit substrate 30 has wirings 31 each of which supplies a signal for driving each piezoelectric element 11. In the embodiment, the piezoelectric elements 11 constitute a piezoelectric actuator for deforming the vibration plate 60 and the piezoelectric elements 11 and the fixing substrate 14 constitute the piezoelectric element unit 10.

Further, a wiring substrate 33 is fixed onto the head case 70. A plurality of conductive pads 32 to which each wiring 31 on the circuit substrate 30 is connected are provided on the wiring substrate 33. The accommodation portion 71 of the head case 70 is substantially closed by the wiring substrate 33. A slit-like opening 34 is formed on the wiring substrate 33 at a region opposed to the accommodation portion 71 of the head case 70. The circuit substrate 30 is bent and drawn toward the outside of the accommodation portion 71 from the opening 34 of the wiring substrate 33.

For example, the circuit substrate 30 constituting the piezoelectric element unit 10 is formed by a Chip on Film (COF) on which a driving IC (not shown) for driving the piezoelectric elements 11 is mounted in the embodiment. Then, the base end side of each wiring 31 on the circuit substrate 30 is connected to the electrode formation materials 16, 17 constituting each piezoelectric element 11 through external electrodes with solder, anisotropic conductive material, or the like, for example. On the other hand, the tip side of each wiring 31 is bonded to each conductive pad 32 of the wiring substrate 33. To be more specific, each wiring 31 is bonded to each conductive pad 32 on the wiring substrate 33 in a state where a tip of the circuit substrate 30 drawn to the outside of the accommodation portion 71 from the opening 34 of the wiring substrate 33 is bent along the surface of the wiring substrate 33.

In the ink jet recording head 100 having the above configuration, when ink droplets are discharged, the volume of each pressure generation chamber 52 is changed by deformation of each piezoelectric element 11 and the vibration plate 60 so that ink droplets are discharged through a predetermined nozzle opening 55. To be more specific, if ink is supplied to the manifold 53 from an ink cartridge (not shown), ink is distributed to each pressure generation chamber 52 through each ink supply path 54. In actuality, each piezoelectric element 11 is contracted by applying a voltage to each piezoelectric element 11. Therefore, the vibration plate 60 is deformed together with each piezoelectric element 11 so that a volume of each pressure generation chamber 52 is enlarged and ink is drawn into each pressure generation chamber 52. Then, after an inner portion to each nozzle opening 55 is filled with ink, the voltage applied to the electrode formation materials 16, 17 of each piezoelectric element 11 is released in accordance with a recording signal supplied through the wiring substrate 33. With this, the vibration plate 60 is also deformed and returns to an original state when each piezoelectric element 11 is extended and returns to an original state. As a result, a volume of each pressure generation chamber 52 is contracted and pressure in each pressure generation chamber 52 is increased so that ink droplets are discharged through each nozzle opening 55.

In the embodiment, if a voltage is applied to the heat generation unit 67, the heat generation unit 67 generates heat so as to heat ink supplied to the manifold 53 to a predetermined temperature. Therefore, viscosity of ink having high viscosity can be lowered and ink can be supplied to each nozzle opening 55 with improved flowability of the ink. Further, the temperature of ink in the manifold 53 is made uniform so that variation in the discharge amount among the nozzles can be suppressed and a uniform amount of ink droplets is discharged through each nozzle opening 55 at a uniform rate. In the embodiment, since ink can be heated in the manifold 53 located immediately before the pressure generation chambers 52, ink at a uniform temperature can be supplied to each pressure generation chamber 52 while the temperature of ink in each pressure generation chamber 52 can be easily adjusted.

Further, heat generated on the heat generation unit 67 can be easily transferred to ink in the manifold 53 by forming the heat generation unit 67 on the elastic film 61 made of a thin film. Therefore, ink can be made to a desired temperature with a low amount of heat.

Further, even when a plurality of ink jet recording heads are installed on an ink jet recording apparatus, ink in the pressure generation chambers 52 can be adjusted to a predetermined temperature in each ink jet recording head 100 by including the heat generation unit 67 in each ink jet recording head 100

(to be more specific, at a region corresponding to the manifold 53). Accordingly, a difference in a discharge amount among the ink jet recording heads is suppressed so as to realize a liquid ejecting apparatus having an excellent discharging characteristic.

Second Embodiment

Figure 4:
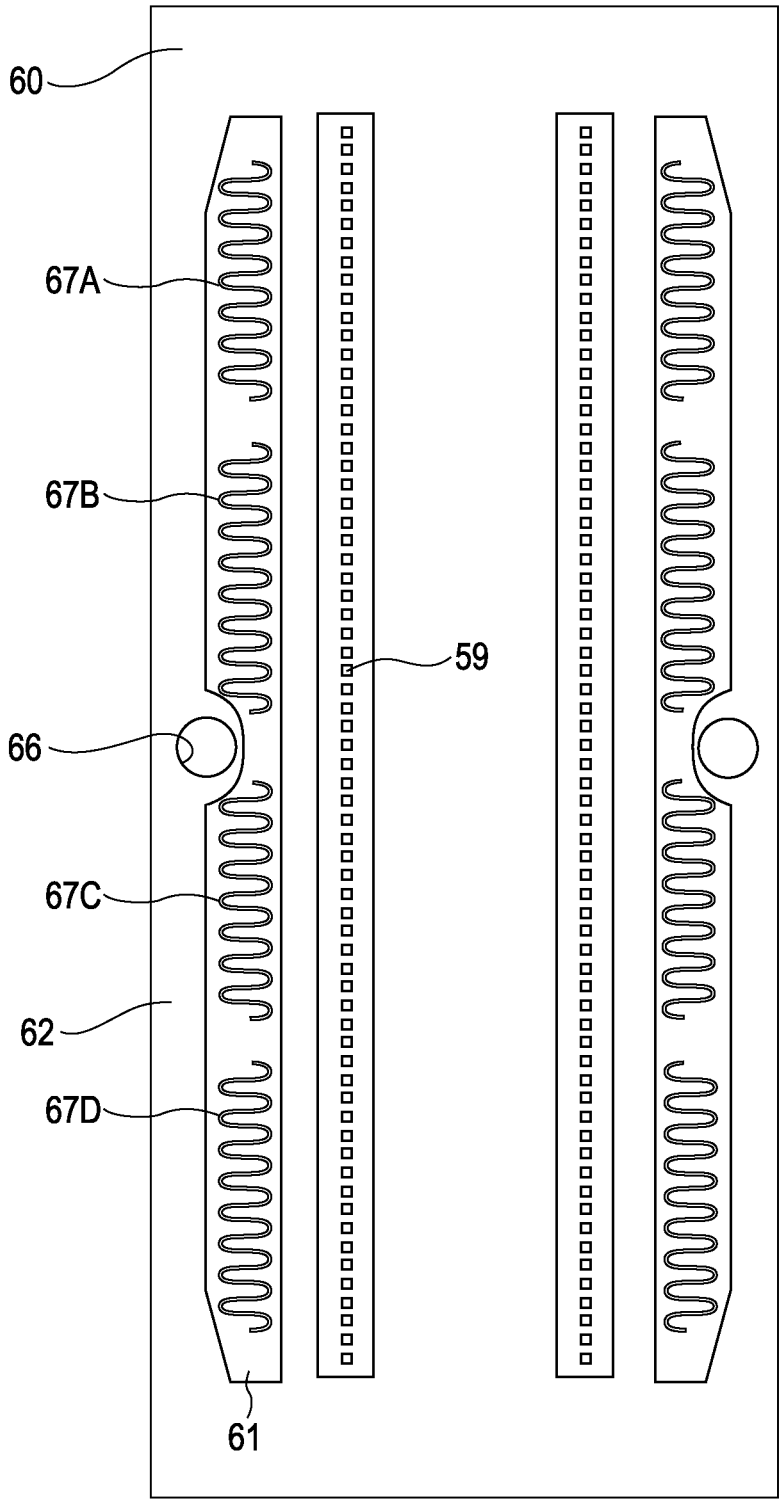
FIG. 4 is a plan view illustrating a sealing substrate according to a second embodiment of the invention.
Figure 5:
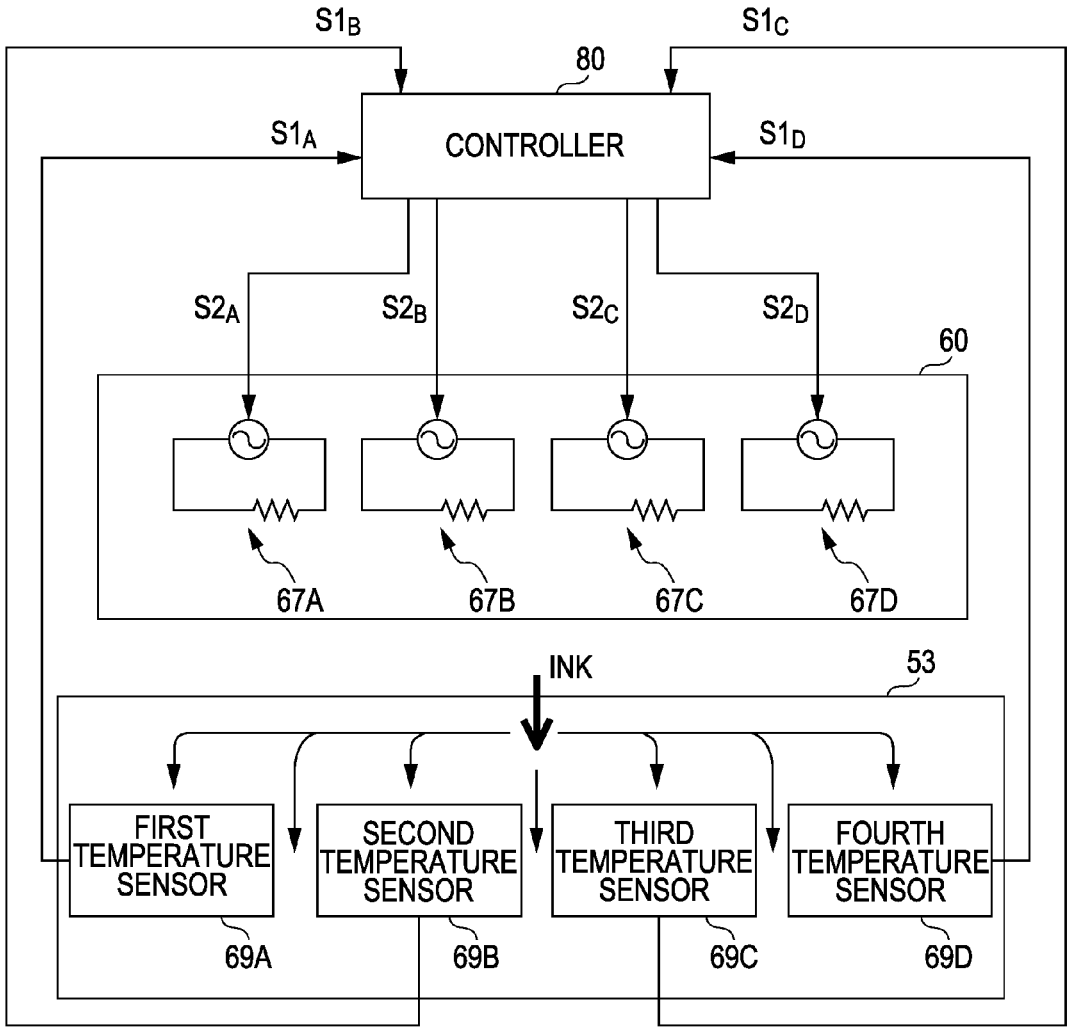
FIG. 5 is a block diagram for explaining a controller according to the second embodiment of the invention.

FIG. 4 is a plan view illustrating a sealing plate (vibration plate 60) of an ink jet recording head as an example of a liquid ejecting head according to a second embodiment of the invention. FIG. 5 is a block diagram illustrating the control of the ink jet recording head according to the second embodiment of the invention. It is to be noted that the same reference numerals denote the same members as those in the above-described first embodiment and explanation thereof is not repeated.

As shown in FIG. 4, a first heat generation unit 67A, a second heat generation unit 67B, a third heat generation unit 67C, and a fourth heat generation unit 67D each of which is made of a metal pattern are provided independently to each other on the compliance portion 65 (elastic film 61), that is, on the elastic film 61 at a region opposed to the manifold 53. Each heat generation unit 67 includes a power supply (not shown) so that a predetermined voltage can be applied to each heat generation unit 67 in accordance with a heat generation amount signal input from a controller 80 (see, FIG. 5).

Further, temperature detection units each of which detects an ink temperature at a predetermined position in the manifold 53 are provided in the manifold 53. In the embodiment, temperature sensors are used as a temperature detection unit. The ink temperature at the predetermined position in the manifold 53, which has been detected by the temperature sensor (temperature detection unit), is transmitted to a controller 80 which will be described later.

Next, the controller and the heat generation amount signals are described with reference to FIG. 5.

As shown in FIG. 5, ink temperatures at predetermined positions in the manifold 53, which have been detected by the temperature sensors 69 (69A, 69B, 69C, 69D), are input to the controller 80 as temperature signals S1 ($S1_A$, $S1_B$, $S1_C$, $S1_D$). The controller 80 determines the amount of heat generation of the heat generation units 67 (67A, 67B, 67C, 67D) based on the temperature signals S1 such that the ink temperature in the manifold 53 is made uniform. Then, the controller 80 generates heat generation amount signals S2 ($S2_A$, $S2_B$, $S2_C$, $S2_D$) for driving each of the heat generation units 67. The generated heat generation amount signals S2 are input to power supplies of the heat generation units 67 (67A, 67B, 67C, 67D). Each heat generation unit 67 generates heat based on each of the signals S2. A method of controlling the heat generation of the heat generation units 67 is not particularly limited. For example, application time of power of each heat generation unit 67 may be adjusted or voltage, pulse, and the like may be changed for each of the heat generation units 67.

In the embodiment, a plurality of temperature sensors 69 (temperature detection units) are included in the manifold 53 and control the amount of heat generation of the heat generation units 67 based on the detection results by the temperature sensors 69. Therefore, the ink temperature in the manifold 53 can be made uniform reliably. Accordingly, liquid at a uniform temperature can be supplied to each nozzle opening more reliably.

Depending on print data, there is a case where utilization states are different among the nozzle rows including a case where a large amount of ink is discharged through one nozzle row and less ink is discharged through another nozzle row. In an existing ink jet recording head, there has arisen a following problem. That is, although a predetermined temperature can be kept at a position in the manifold 53 corresponding to a nozzle row through which a large amount of ink is discharged, a temperature is lowered at a position corresponding to a nozzle row through which a small amount of ink is discharged. In the ink jet recording head according to the embodiment, the temperatures of ink in the manifold 53 is fed back to control an amount of heat generation in each of the heat generation units 67. With this, a temperature at each position in the manifold 53 can be kept to be constant without being influenced by discharge amounts of ink (flow amount of ink).

Further, in general, if heat is excessively applied to ink, performance of the ink is deteriorated and printing quality is deteriorated. However, in the embodiment, the amount of heat generation of the heat generation unit 67 can be appropriately adjusted in accordance with the ink temperature in the manifold 53. Therefore, deterioration in quality of ink due to excessive heating can be suppressed.

Further, since ink is supplied from the ink supply hole 66, it is preferable that the heat generation amount in the vicinity of the ink supply hole 66 be larger in comparison with those of other portions in order to heat the supplied ink in the vicinity of the ink supply hole 66 in the manifold 53. In the embodiment, since the plurality of heat generation units 67 are provided so as to be independent of each other, the amount of heat generation can be changed depending on positions. For example, the amount of heat generation of the second heat generation unit 67B and the third heat generation unit 67C can be made larger than the amount of heat generation of the first heat generation unit 67A and the fourth heat generation unit 67D.

Further, the ink jet recording head 100 according to the embodiment includes two liquid flow paths and new ink by a discharged ink amount is flown into each manifold 53. On the liquid flow path through which a large amount of ink is discharged, an amount of ink flowing into the manifold 53 is large and a required heat amount in order to realize a desired temperature is large. On the other hand, on the liquid flow path through which a small amount of ink is discharged, an amount of ink flowing into the manifold 53 is small and a required heat amount in order to realize a desired temperature is small. In the embodiment, an amount of heat generation can be appropriately adjusted in accordance with a detection result of an ink temperature in each manifold 53, that is, change in the ink temperature. Accordingly, an ink temperature on each of the liquid flow paths can be made to be a desired temperature.

Another Embodiment

Hereinbefore, the first and second embodiments of the invention have been described. However, a basic configuration of the invention is not limited to the above embodiments. For example, in the above-described first and second embodiments, the heat generation unit 67 having uniform length and width is provided on the elastic film 61 of the vibration plate 60 at a region opposed to the manifold 53. However, configurations thereof are not limited thereto and a heat generation unit 67 having different lengths and widths among ranges may be formed.

Figure 6A:
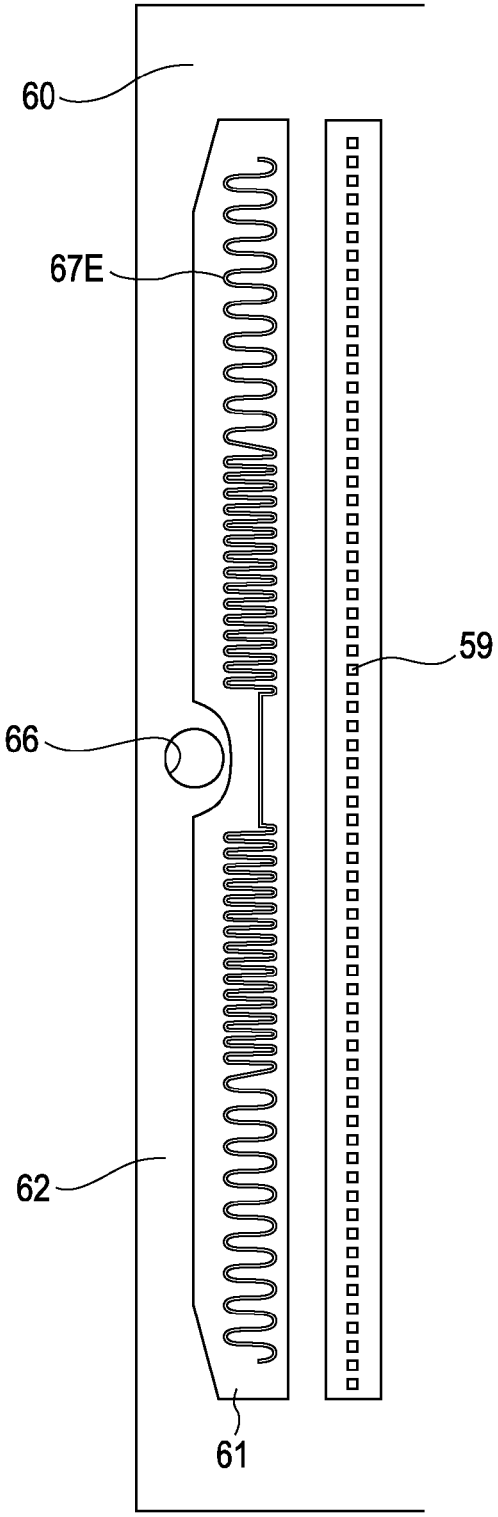
FIGS. 6A and 6B are a plan view illustrating a sealing substrate according to another embodiment of the invention.
Figure 6B:
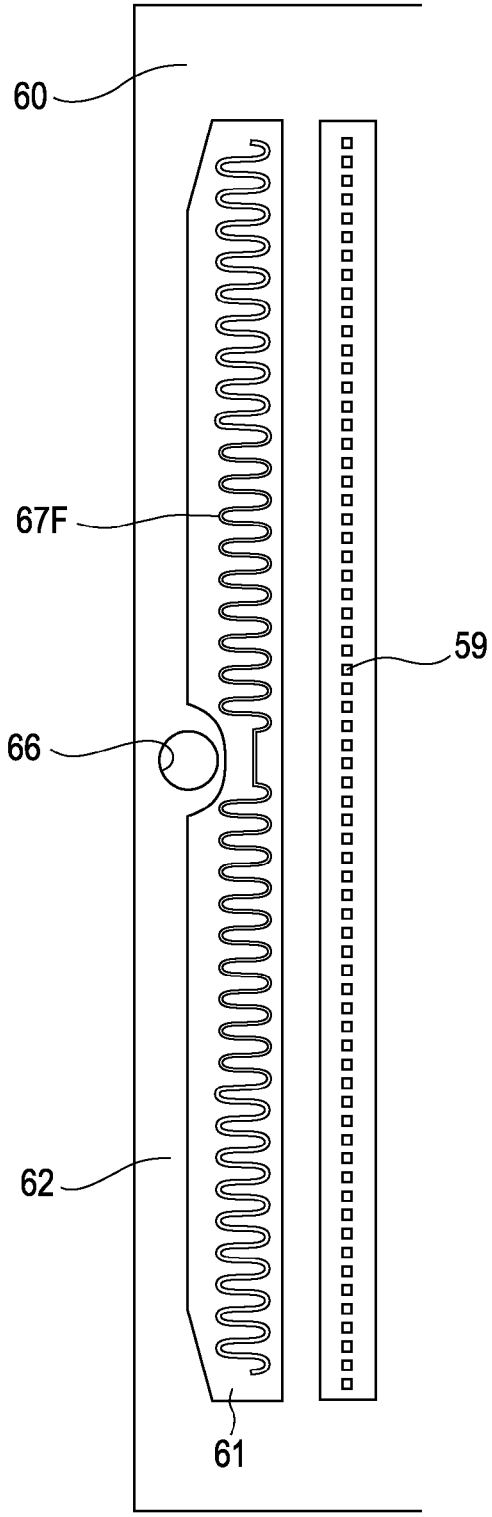

For example, as shown in FIG. 6A, the heat generation unit 67E is formed such that the length thereof is made longer in the vicinity of the ink supply hole 66. That is to say, the heat generation unit 67E is formed such that the pitch (interval) of the winding heat generation unit 67E is made smaller and the heat generation unit 67E is densely provided in the vicinity of the ink supply hole 66. The amount of heat generation may be made large in such a manner. An ink temperature tends to be lowered in the vicinity of the supply hole 66 through which ink is introduced. However, the amount of heat generation is made large by making the heat generation unit 67E in the vicinity of the supply hole 66 longer, thereby preferably suppressing the ink temperature from being lowered in the vicinity of the supply hole 66. This enables ink at a uniform temperature to be reliably supplied to each pressure generation chamber 52. Further, as shown in FIG. 6B, the heat generation unit 67F is formed such that the width thereof is made smaller in the vicinity of the ink supply hole 66. An amount of heat generation may be made large in such a manner. Also in this case, the ink temperature in the vicinity of the ink supply hole 66 can be preferably suppressed from being lowered. Further, the heat generation amount of the heat generation unit may be made larger by forming the heat generation unit such that the width thereof is made smaller and the length thereof is made longer in the vicinity of the ink supply hole 66.

The heat generation unit may be formed such that width thereof is made smaller or length thereof is made longer in a range where temperature thereof tends to be lowered, as described above. In contrast, the heat generation unit may be formed such that width thereof is made wider or length thereof is made shorter in a range where temperature thereof does not tend to be lowered. In such a manner, the heat generation unit 67 can be formed so as to obtain a desired amount of heat generation by changing the length and width among predetermined ranges.

In the second embodiment, the temperature sensors 69 are provided in the manifold 53. However, the temperature sensors 69 may be provided on the ink supply paths 54 or the pressure generation chambers 52.

Further, in the second embodiment, four heat generation units 67 are provided. However, the number of the heat generation units 67 is not limited to four.

In addition, in the second embodiment, a plurality of the heat generation units 67 are provided so as to be independent of each other and a predetermined voltage can be applied thereto based on temperature detection results by the corresponding temperature sensors 69. However, the number of the temperature sensors 69 is not limited thereto. For example, in a case where the number of the temperature sensors 69 is smaller than the number of the heat generation units 67, changing state of an ink temperature at each position in the manifold 53 may be predicted to appropriately set an amount of heat generation of each heat generation unit 67 by predicting and considering length of a flow path on the manifold 53 or an ejection amount of liquid discharged through each nozzle row.

Further, in the above embodiments, a longitudinal vibration type piezoelectric element 11 formed by alternately laminating the piezoelectric material layers 15 and the electrode formation materials 16, 17 so as to extend and contract in a shaft direction has been described. However, the piezoelectric element is not particularly limited thereto and a flexural vibration type piezoelectric element formed by sequentially laminating a first electrode, a piezoelectric material layer, and a second electrode on a substrate (flow path formation substrate) may be used, for example.

In an example as shown in FIG. 1, each of the ink jet recording head units 1A, 1B has one ink jet recording head 100. However, the invention is not particularly limited thereto and one ink jet recording head unit 1A or 1B may have equal to or more than two ink jet recording heads.

In addition, in the above embodiments, the ink jet recording head 100 which discharges ink droplets has been described as an example. However, the invention is widely aimed at liquid ejecting heads in general. As other liquid ejecting heads, recording heads used for image recording apparatuses such as a printer, color material ejecting heads used for manufacturing color filters such as a liquid crystal display, electrode material ejecting heads used for forming electrodes such as an organic EL display and a field emission display (FED), bioorganic compound ejecting heads used for manufacturing a bio chip, and the like are exemplified.

What is claimed is:

1. A liquid ejecting head comprising:

a pressure generation chamber which fluidly communicates with a nozzle opening through which liquid is discharged;

a pressure generation unit which causes pressure change on liquid in the pressure generation chamber;

a manifold which serves as a liquid chamber common to a plurality of the pressure generation chambers;

a flexible film which is configured to cover at least a portion of the manifold so as to absorb a pressure change generated in the manifold;

a vibration plate formed in part by the flexible film and a supporting plate; and a heat generation unit which is formed on the flexible film at a region opposed to the manifold, is a part of the vibration plate formed discontinuously relative to the supporting plate, and is made of a patterned metal.

2. The liquid ejecting head according to claim 1, wherein the heat generation unit is configured such that the amount of heat generation are different among predetermined ranges.

3. The liquid ejecting head according to claim 1, wherein the heat generation unit has a linear shape and is configured such that pattern widths are different among predetermined ranges.

4. The liquid ejecting head according to claim 2, wherein the heat generation unit has a linear shape and is configured such that pattern lengths are different among predetermined ranges.

5. The liquid ejecting head according to claim 1, wherein a plurality of the heat generation units are provided on the flexible film at a region opposed to the manifold, and a controller which independently controls an amount of heat generation of each heat generation unit is provided.

6. The liquid ejecting head according to claim 1, wherein a temperature detection unit which detects a temperature in a liquid flow path including the pressure generation chamber and the manifold is provided, and the controller which controls an amount of heat generation of each heat generation unit based on a detection result by the temperature detection unit is provided.

7. The liquid ejecting head according to claim 1, wherein the heat generation unit is extended from a region opposed to the manifold to the outside of the region.

8. A liquid ejecting head unit comprising the liquid head according to claim 1.

9. A liquid ejecting apparatus comprising the liquid head according to claim 1.

10. A liquid ejecting apparatus comprising the liquid head unit according to claim 8.

11. The liquid ejecting head according to claim 1, wherein the flexible film is an elastic film.

12. The liquid ejecting head according to claim 1, wherein the heat generation unit is made of the same material as that of the supporting plate.

* * * * *